United States Patent [19]

Nakaso et al.

[11] Patent Number: 4,557,762

[45] Date of Patent: Dec. 10, 1985

[54] ELECTROLESS COPPER PLATING SOLUTION

[75] Inventors: Akishi Nakaso, Oyama; Toshiro Okamura; Kiyoshi Yamanoi, both of Shimodate; Sumiko Nakajima, Ibaraki, all of Japan

[73] Assignee: Hitachi Chemical Company, Tokyo, Japan

[21] Appl. No.: 635,403

[22] Filed: Jul. 30, 1984

[30] Foreign Application Priority Data

Aug. 4, 1983 [JP] Japan ..... 58-142686

[51] Int. Cl.[4] ..... C23C 3/02

[52] U.S. Cl. ..... 106/1.23; 106/1.26

[58] Field of Search ..... 106/1.23, 1.26

[56] References Cited

U.S. PATENT DOCUMENTS

| | | | |
|---|---|---|---|
| 3,095,309 | 6/1963 | Zeblisky et al. | 427/443.1 |
| 3,607,317 | 9/1971 | Schneble, Jr. | 427/443.1 |
| 4,059,451 | 11/1977 | Oita et al. | 106/1.26 |
| 4,099,974 | 7/1978 | Morishita et al. | 106/1.23 |

OTHER PUBLICATIONS

Montefluos, Fomblin, Perfluoro Polyethers, Lubricants for Surface Lubrication of Magnetic Media

*Primary Examiner*—Lorenzo B. Hayes

*Attorney, Agent, or Firm*—Antonelli, Terry & Wands

[57] ABSTRACT

An electroless copper plating solution comprising cupric ions, a complexing agent, a reducing agent, a pH adjuster, a perfluoropolyether, a cyanide and/or $\alpha,\alpha'$-dipyridyl and/or 1,10-phenanthroline or a derivative thereof is capable of forming a deposited film with high elongation.

8 Claims, No Drawings

ELECTROLESS COPPER PLATING SOLUTION

The present invention relates to an electroless copper plating solution capable of forming a deposited film with high elongation.

In the manufacture of printed wiring boards, an electroless copper plating solution is used for forming conductors on insulating substrates. Currently, the following two processes are mainly employed for forming conductors on insulating substrates by using an electroless copper plating solution.

One process (called "full additive process") comprises coating a plating resist on non-conductor areas of an insulating substrate and then dipping the insulating substrate in an electroless copper plating solution to form conductors of an electroless plated copper film on the areas of the insulating substrate not coated with the plating resist. Another process (called "semi-additive process") comprises immersing an insulating substrate in an electroless copper plating solution to form a thin electroless copper deposited film on the entire surface of the insulating substrate, then coating a plating resist on non-conductor areas of the substrate, conducting electroplating of copper to form an electroplated copper film on the resistless areas, and then removing the plating resist, removing the thin electroless plated copper film at the area having no electroplated copper film by means of quick etching to thereby form the desired conductors on the insulating substrate.

Electroless copper plating solutions generally comprise a cupric salt such as cupric sulfate, an alkali-soluble complexing agent for cupric ions such as ethylenediaminetetracetic acid, a reducing agent such as formaldehyde and a pH adjuster which is an alkali hydroxide. The deposited films obtained by using known plating solutions are usually brittle. If the deposited film is brittle and low in elongation in the case of a printed wiring board, conductors easily break at corner portions of through-holes (the circumferential angular portions of the through-holes) due to expansion and shrinkage of the substrate depending on temperature changes.

In order to overcome this problem, it has been proposed to add certain specific compounds such as a cyanide, $\alpha,\alpha'$-dipyridyl, a 1,10-phenanthroline, polyalkylene oxide, polyethylene glycol and the like to a plating solution. For instance, U.S. Pat. No. 3,095,309 proposes the addition of a cyanide and U.S. Pat. No. 3,607,317 proposes the combined use of a cyanide and a polyalkylene oxide. Also, in U.S. Pat. No. 4,099,974 is proposed the addition of 2,2'-dipyridyl or 2,9-dimethyl-1,10-phenanthroline, and a polyethylene glycol. However, any of these proposals are insufficient for the improvement in elongation of the deposited film although gloss is provided on the film.

An object of this invention is to provide an electroless copper plating solution capable of forming a deposited film with high elongation.

The present invention provides an electroless copper plating solution comprising:

(a) cupric ions, a complexing agent for cupric ions, a reducing agent and a pH adjuster;

(b) a fluoropolyether of the formula:

$$-(O-\underset{}{\overset{CR_3}{\overset{|}{C}}}R-CR_2)_k-(O-CR_2-\overset{CR_3}{\overset{|}{C}}R)_m-(O-CR_2)_n-, \text{ or}$$

-continued $$-(O-CR_2-CR_2)_p-(O-CR_2)_q-$$

wherein each R is fluorine, a part of which may be substituted with hydrogen and/or chlorine; k and m are each zero or a positive number (but k and m cannot be zero at the same time); and n, p and q are each a positive number; and (c) at least one member selected from the group consisting of a cyanide, $\alpha,\alpha'$-dipyridyl, and 1,10-phenanthroline and a derivative thereof.

The fluoropolyether used in the present invention is represented by the general formula:

$$-(O-\overset{CR_3}{\overset{|}{C}}R-CR_2)_k-(O-CR_2-\overset{CR_3}{\overset{|}{C}}R)_m-(O-CR_2)_n-, \text{ or}$$

$$-(O-CR_2-CR_2)_p-(O-CR_2)_q-$$

wherein each R is fluorine, a part of which may be substituted with hydrogen and/or chlorine; k and m are each zero or a positive number (but k and m cannot be zero at the same time); and n, p and q are each a positive number.

The fluoropolyether used in this invention preferably has a molecular weight (a number average molecular weight) in the range of 500 to 50,000.

It is desirable in this invention to use at least one of those fluoropolyethers which are represented by the general formula:

$$-(O-\overset{CF_3}{\overset{|}{C}}F-CF_2)_r-(O-CF_2)_s-, \text{ or}$$

$$-(O-CF_2-CF_2)_t-(O-CF_2)_u-$$

wherein r, s, t and u are each a positive number.

Some of these fluoropolyethers are commercially available, such as Fomblin Y and Fomblin Z manufactured by Montefluos S.p.A. (Italy).

Fomblin Y has the following chemical structure:

$$-(O-\overset{CF_3}{\overset{|}{C}}F-CF_2)_r-(O-CF_2)_s-$$

Fomblin Z has the following chemical structure:

$$-(O-CF_2-CF_2)_t-(O-CF_2)_u-$$

These commercial fluoropolyethers range in number average molecular weight from about 1,000 to 20,000, and any of these commercial products can be used in this invention.

The solubility of fluoropolyethers in the plating solution is very low. In this invention, it suffices to add a fluoropolyether in a small effective amount, for example 0.01 mg/l or greater, preferably not exceeding 50 mg/l. Excess addition gives no adverse effect to the elongation of the copper deposit. When this compound is added in an excess amount, it merely undergoes a phase separation from the plating solution and is dispersed in the manner of oil. Thus, when the compound is added in an excess amount, the concentration in the plating solution is self controlled by the solubility of the compound. Two or more different types of fluoropolyether can be used in admixture. A part of the fluorine atoms in the fluoropolyether may be substituted with one or more hydrogen and/or chlorine atoms.

As the cyanide, there can be used metal cyanides such as sodium cyanide (NaCN), potassium cyanide (KCN), nickel cyanide (NiCN), cobalt cyanide ($Co(CN)_2$), etc.; cyano-complex compounds such as sodium ferrocyanide ($Na_4(Fe(CN)_6)$), potassium ferrocyanide ($K_4(Fe(CN)_6)$), sodium ferricyanide ($Na_3(Fe(CN)_6)$), potassium ferricyanide ($K_3(Fe(CN)_6)$), sodium nitroprusside ($Na_2Fe(CN)_5(NO)$), etc.; and organic cyanides such as glycolonitrile ($HOCH_2CN$), aminoacetonitrile ($NH_2CH_2CN$), etc. The concentration of the cyanide is preferably in the range of 2 to 200 mg/l. When the cyanide concentration is less than 2 mg/l or exceeds 200 mg/l, no deposited film with a satisfactorily high elongation can be obtained. The more preferred range of cyanide concentration is 5 to 80 mg/l and the most preferred range is 10 to 50 mg/l.

The concentration of $\alpha,\alpha'$-dipyridyl is preferably within the range of 5 to 300 mg/l. When it is below 5 mg/l, there can be obtained no deposited film with a satisfactorily high elongation, and when said concentration exceeds 300 mg/l, the depositing rate is reduced. The $\alpha,\alpha'$-dipyridyl concentration is more preferably 10 to 150 mg/l and most preferably 15 to 60 mg/l.

As 1,10-phenanthroline or derivatives thereof, there can be used, for example, 1,10-phenanthroline, 4,7-diphenyl-1,10-phenanthroline and 2,9-dimethyl-1,10-phenanthroline. The concentration of such 1,10-phenanthrolines is preferably in the range of 5 to 300 mg/l. If the concentration is less than 5 mg/l, it is impossible to obtain a deposited film with a sufficiently high elongation, and if said concentration exceeds 300 mg/l, the depositing rate is reduced. The more preferred range of 1,10-phenanthroline concentration is 10 to 150 mg/l and the most preferred range is 15 to 60 mg/l.

The cupric ions are supplied by an organic or inorganic cupric salt such as cupric sulfate, cupric nitrate, cupric chloride, cupric bromide, cupric acetate and the like. Such cupric ions preferably exist in a concentration of 0.004 to 0.2 mol/l.

The complexing agent for those cupric ions is a compound which forms with cupric ions a complex soluble in aqueous alkali solutions. Typical examples of such a complexing agent are ethylenediaminetetraacetic acid and its sodium salt, Rochelle salts, N,N,N',N'-tetrakis-(2-hydroxypropyl)-ethylenediamine, triethanolamine, ethylenenitrilotetraethanol and the like. The preferred concentration of the complexing agent in the plating solution is 0.004 to 1 mol/l.

As the reducing agent, formaldehyde or paraformaldehyde can be used in an amount of preferably 0.01 to 0.25 mol/l.

As the pH adjuster, alkali hydroxides such as sodium hydroxide, potassium hydroxide and the like can be used. Such pH adjuster is preferably used in an amount necessary for adjusting the pH of the solution to 11.0 to 13.5.

The fundamental composition of the electroless copper plating solution of this invention preferably comprises 5 to 15 g/l of cupric sulfate, 15 to 60 g/l of ethylenediaminetetraacetic acid as a complexing agent and 2 to 20 ml/l of a 37% aqueous formaldehyde solution as a reducing agent, and it is preferred that the solution be adjusted to a pH of 11.6 to 13.0 and used at a temperature of 60° to 80° C.

As described above, the electroless plating solution of this invention is capable of providing a deposited film with a high elongation and can be advantageously used for forming circuits on a substrate in the manufacture of printed wiring boards according principally to the full additive or semi-additive process.

EXAMPLES 1-8 AND COMPARATIVE EXAMPLES 1-5

Stainless steel plates having smooth polished surfaces had their surfaces degreased and applied with Pd serving as a reaction initiator (catalyst) and then were subjected to electroless copper plating at 70° C. by using the plating solutions having the compositions shown in Table 1 to obtain the deposited copper films.

The deposited films formed on said stainless steel plates were peeled off from the substrate surfaces and cut to pieces measuring 10 mm width and 80 mm long, and their film properties were measured by using a tensile tester (TENSILON/UTM-1-5000 BW, manufactured by TOYO BALDWING CO., LTD. (Japan)) at a crosshead speed of 1 mm/min and a gage length of 15 mm. The results are shown in Table 2.

TABLE 1

| | Example | | | | | | | | Comparative Example | | | | | |
|---|---|---|---|---|---|---|---|---|---|---|---|---|---|---|
| | 1 | 2 | 3 | 4 | 5 | 6 | 7 | 8 | 1 | 2 | 3 | 4 | 5 | 6 |
| $CuSO_4.5H_2O$ (g/l) | 10 | 10 | 10 | 10 | 7 | 7 | 7 | 7 | 10 | 10 | 10 | 10 | 10 | 10 |
| EDTA* (g/l) | 30 | 30 | 30 | 30 | 30 | 30 | 30 | 30 | 20 | 30 | 30 | 30 | 30 | 30 |
| HCHO 37% aqueous solution (ml/l) | 3.5 | 3.5 | 3.5 | 3.5 | 3.5 | 3.5 | 3.5 | 3.5 | 3.5 | 3.5 | 3.5 | 3.5 | 3.5 | 3.5 |
| Fluoropolyether (g/l) | | | | | | | | | | | | | | |
| Fomblin Y | | | | | | | | | | | | | | |
| MW** 1500 | 0.1 | — | — | — | — | — | — | — | 0.1 | — | — | — | — | — |
| MW 3000 | — | — | 0.1 | — | — | 0.1 | — | — | — | — | — | — | — | — |
| MW 6500 | — | 0.1 | — | 0.1 | — | — | 0.1 | 0.1 | — | 0.1 | — | — | — | — |
| Fomblin Z | | | | | | | | | | | | | | |
| MW 145000 | — | — | — | — | 0.1 | — | — | — | — | — | 0.1 | — | — | — |
| NaCN (ml/l) | — | — | — | — | — | — | 40 | — | — | — | — | — | 40 | — |
| Sodium ferrocyanide (ml/l) | 30 | 40 | — | — | — | — | — | 10 | — | — | — | — | — | — |
| $\alpha,\alpha'$-Dipyridyl (ml/l) | — | — | 50 | 25 | 30 | — | — | 40 | — | — | — | 30 | — | — |
| 1,10-Phenanthro- | — | — | — | — | — | 30 | — | — | — | — | — | — | — | — |

TABLE 1-continued

| | Example | | | | | | | | Comparative Example | | | | | |
|---|---|---|---|---|---|---|---|---|---|---|---|---|---|---|
| | 1 | 2 | 3 | 4 | 5 | 6 | 7 | 8 | 1 | 2 | 3 | 4 | 5 | 6 |
| line (ml/l) | | | | | | | | | | | | | | |
| pH*** | 12.0 | 12.0 | 12.5 | 12.5 | 12.3 | 12.5 | 12.0 | 12.0 | 12.3 | 12.3 | 12.3 | 12.3 | 12.3 | 12.0 |

Notes:
*EDTA: ethylenediaminetetraacetic acid.
**MW: number average molecular weight.
***pH: at solution temperature of 20° C. (pH adjuster: NaOH).

TABLE 2

| | Elongation of deposited film (%) | Tensile strength of deposited film (km/mm$^2$) | Depositing rate (μm/hr) | Deposited film thickness (μm) | Glossy |
|---|---|---|---|---|---|
| Example | | | | | |
| 1 | 12.5 | 33.5 | 2.8 | 29.5 | Yes |
| 2 | 11.5 | 30.0 | 2.4 | 25.4 | Yes |
| 3 | 10.1 | 37.7 | 2.6 | 25.2 | Yes |
| 4 | 11.7 | 34.5 | 2.7 | 27.1 | Yes |
| 5 | 11.8 | 33.2 | 2.4 | 26.3 | Yes |
| 6 | 9.6 | 32.1 | 2.5 | 28.1 | Yes |
| 7 | 9.4 | 34.3 | 2.7 | 26.1 | Yes |
| 8 | 11.6 | 32.7 | 2.3 | 26.5 | Yes |
| Comparative Example | | | | | |
| 1 | 4.8 | 35.4 | 2.6 | 25.9 | No |
| 2 | 5.4 | 36.1 | 2.4 | 27.3 | No |
| 3 | 5.2 | 33.6 | 2.5 | 28.2 | No |
| 4 | 4.1 | 33.2 | 3.8 | 26.5 | Yes |
| 5 | 4.3 | 32.7 | 2.6 | 27.4 | Yes |
| 6 | 2.9 | 35.0 | 3.6 | 28.5 | No |

What is claimed is:

1. An electroless copper plating solution comprising:
(a) cupric ions, a complexing agent for cupric ions, a reducing agent and a pH adjuster;
(b) a fluoropolyether of the formula:

$$-(O-\overset{\overset{CR_3}{|}}{C}R-CR_2)_k-(O-CR_2-\overset{\overset{CR_3}{|}}{C}R)_m-(O-CR_2)_n-, \text{ or}$$

$$-(O-CR_2-CR_2)_p-(O-CR_2)_q-$$

wherein each R is fluorine, k and m are each zero or a positive number, providing k and m are not zero at the same time; and n, p and q are each a positive number; and
(c) at least one member selected from the group consisting of a cyanide, α,α'-dipyridyl and 1,10-phenanthroline or a derivative thereof.

2. An electroless copper plating solution according to claim 1, wherein the fluoropolyether is at least one of the fluoropolyethers of the formula:

$$-(O-\overset{\overset{CF_3}{|}}{C}F_1-CF_2)_r-(O-CF_2)_s-, \text{ or}$$

$$-(O-CF_2-CF_2)_t-(O-CF_2)_u-$$

wherein r, s, t and u are each a positive number.

3. An electroless copper plating solution according to claim 1, wherein the fluoropolyether is used in an amount of 50 mg/l or less.

4. An electroless copper plating solution according to claim 2, wherein the fluoropolyether has a number average molecular weight of 1,000 to 20,000.

5. An electroless copper plating solution according to claim 1, wherein component (c) is a cyanide selected from the group consisting of sodium cyanide, potassium cyanide, nickel cyanide, cobalt cyanide, sodium ferrocyanide, potassium ferrocyanide, sodium ferricyanide, potassium ferricyanide, sodium nitroprusside, glycolonitrile and aminoacetonitrile and is in a concentration of 2 to 200 mg/l.

6. An electroless copper plating solution according to claim 1, wherein component (c) is α,α'-dipyridyl and is in a concentration of 5 to 30 mg/l.

7. An electroless copper plating solution according to claim 1, wherein component (c) is 1,10-phenanthroline or a derivative thereof selected from the group consisting of 4,7-diphenyl-1,10-phenanthroline and 2,9-dimethyl-1,10-phenanthroline and is in a concentration of 5 to 30 mg/l.

8. An electroless copper plating solution according to claim 1, wherein the cupric ions are in a concentration of 0.004 to 0.2 mol/l; the complexing agent is in a concentration of 0.004 to 1 mol/l; and the reducing agent is in a concentration of 0.01 to 0.25 mol/l; the pH adjuster being contained in an amount necessary to adjust the pH of the solution to 11.0 to 13.5.

* * * * *

UNITED STATES PATENT AND TRADEMARK OFFICE

CERTIFICATE OF CORRECTION

PATENT NO. : 4,557,762

DATED : December 10, 1985

INVENTOR(S) : NAKASO, et al

It is certified that error appears in the above-identified patent and that said Letters Patent is hereby corrected as shown below:

Title page, left-hand column:

"[73] Assignee: Hitachi Chemical Company, Tokyo,"
should read

--[73] Assignee: Hitachi Chemical Company, Ltd., Tokyo,--

Signed and Sealed this

*Twentieth* Day of *May 1986*

[SEAL]

*Attest:*

DONALD J. QUIGG

*Attesting Officer*

*Commissioner of Patents and Trademarks*